US007891517B2

(12) United States Patent
Simmons

(10) Patent No.: US 7,891,517 B2
(45) Date of Patent: Feb. 22, 2011

(54) APPARATUS FOR SEALING A BEVERAGE CAN

(76) Inventor: Samantha Simmons, 1002 Chambord Pl., West Chester, PA (US) 19380

( * ) Notice: Subject to any disclaimer, the term of this patent is extended or adjusted under 35 U.S.C. 154(b) by 1027 days.

(21) Appl. No.: 11/652,684

(22) Filed: Jan. 12, 2007

(65) Prior Publication Data

US 2008/0169299 A1 Jul. 17, 2008

(51) Int. Cl.

| | |
|---|---|
| ***B65D 45/00*** | (2006.01) |
| ***B65D 51/18*** | (2006.01) |
| ***B65D 41/32*** | (2006.01) |
| ***B65D 43/26*** | (2006.01) |
| ***B65D 43/18*** | (2006.01) |

(52) U.S. Cl. ..... 220/243; 220/816; 220/820; 220/254.4; 220/263; 220/906; 220/266

(58) Field of Classification Search ..... 220/906, 220/269, 254.1, 214, 266, 265, 268, 243, 220/254.2, 254.3, 254.4, 820, 816, 817, 811, 220/263, 819

See application file for complete search history.

(56) References Cited

U.S. PATENT DOCUMENTS

| | | | | |
|---|---|---|---|---|
| 2,733,052 | A | 1/1956 | Luther | |
| 2,974,824 | A | 3/1961 | Mansho | |
| 3,071,286 | A * | 1/1963 | Valvano | 220/278 |
| 3,141,586 | A | 7/1964 | Wetterek | |
| 3,151,740 | A | 10/1964 | Simon | |
| 3,262,612 | A | 7/1966 | Tabor | |
| 3,289,881 | A | 12/1966 | Ganung | |
| 3,331,638 | A | 7/1967 | Fruth | |
| 3,604,596 | A * | 9/1971 | Khoury et al. | 222/153.06 |
| 3,672,547 | A | 6/1972 | Kozlowski | |
| 3,982,656 | A * | 9/1976 | Kusmierski et al. | 220/238 |
| 4,429,804 | A * | 2/1984 | Pease | 220/247 |
| 4,441,622 | A | 4/1984 | von Holdt | |
| 4,804,103 | A * | 2/1989 | Goldberg | 220/251 |
| 4,813,569 | A | 3/1989 | Ruiz | |
| 5,443,175 | A | 8/1995 | Kelly et al. | |
| 6,398,050 | B1 | 6/2002 | Allora | |
| 7,051,896 | B2 | 5/2006 | Steadman | |
| 2003/0057173 | A1 | 3/2003 | Wagner | |
| 2004/0065664 | A1 | 4/2004 | Steadman | |
| 2007/0257037 | A1 * | 11/2007 | Scarborough | 220/269 |

* cited by examiner

*Primary Examiner*—Robin Hylton
(74) *Attorney, Agent, or Firm*—Dickstein Shapiro LLP

(57) ABSTRACT

An opening assembly that provides a beverage can with the ability to be closed once opened. The opening assembly allows a user to open and close a beverage can while protecting the integrity of the can, thus providing an improved beverage can that has the ability to seal-in carbonation.

12 Claims, 6 Drawing Sheets

APPARATUS FOR SEALING A BEVERAGE CAN

FIELD OF THE INVENTION

The present invention relates generally to opening assemblies for beverage containers, and in particular although not exclusively, opening assemblies for beverage cans usable with, e.g., carbonated beverages.

BACKGROUND OF THE INVENTION

One type of container typically used for carbonated beverages is an aluminum can with a ring pull arrangement. The beverage can in commercial use at the present time, features a small, elliptical, sealed opening that is ruptured when a tab is pulled upwardly from the lid. While these cans have proven to be very popular, a number of disadvantages are associated with them. For instance, it is not possible to close the beverage can once it is opened. The contents, therefore, must be consumed at one time. This can be a particular problem with children or while traveling. The open container cannot prevent spills. Further, if the contents are carbonated, the open container cannot preserve the beverage's carbonation. It is also known that aluminum cans are an advantageous beverage container because they allow a beverage to remain cold for a longer period.

In addition, an open container is susceptible to health contaminations. For example, when a user wishes to drink directly out of a can, he/she must usually place his/her lips against the outer surface of the can. This outer surface is usually contaminated with all kinds of dirt and pollution resulting from warehousing and handling of various kinds during packaging, transport and storage of the cans. Furthermore, the cans are often set down on the ground and are thus within the reach of animals or can come into contact with chemicals, detritus, grease, oils, etc.

Accordingly, there is a need and desire for an opening assembly for a beverage container that also provides the ability to close the container once opened.

BRIEF SUMMARY OF THE INVENTION

The present invention relates to an opening assembly that provides a substantially air-tight closing mechanism for a beverage container. The opening assembly allows a user to open and close the container to protect the air-tightness integrity of the container, prevent spills, and to reduce the possibility of contamination. The opening assembly also provides an improved beverage can that seals-in carbonation.

BRIEF DESCRIPTION OF THE DRAWINGS

The foregoing and other advantages and features of the invention will become more apparent from the detailed description of exemplary embodiments provided below with reference to the accompanying drawings in which.

DETAILED DESCRIPTION OF THE INVENTION

Figure 1:
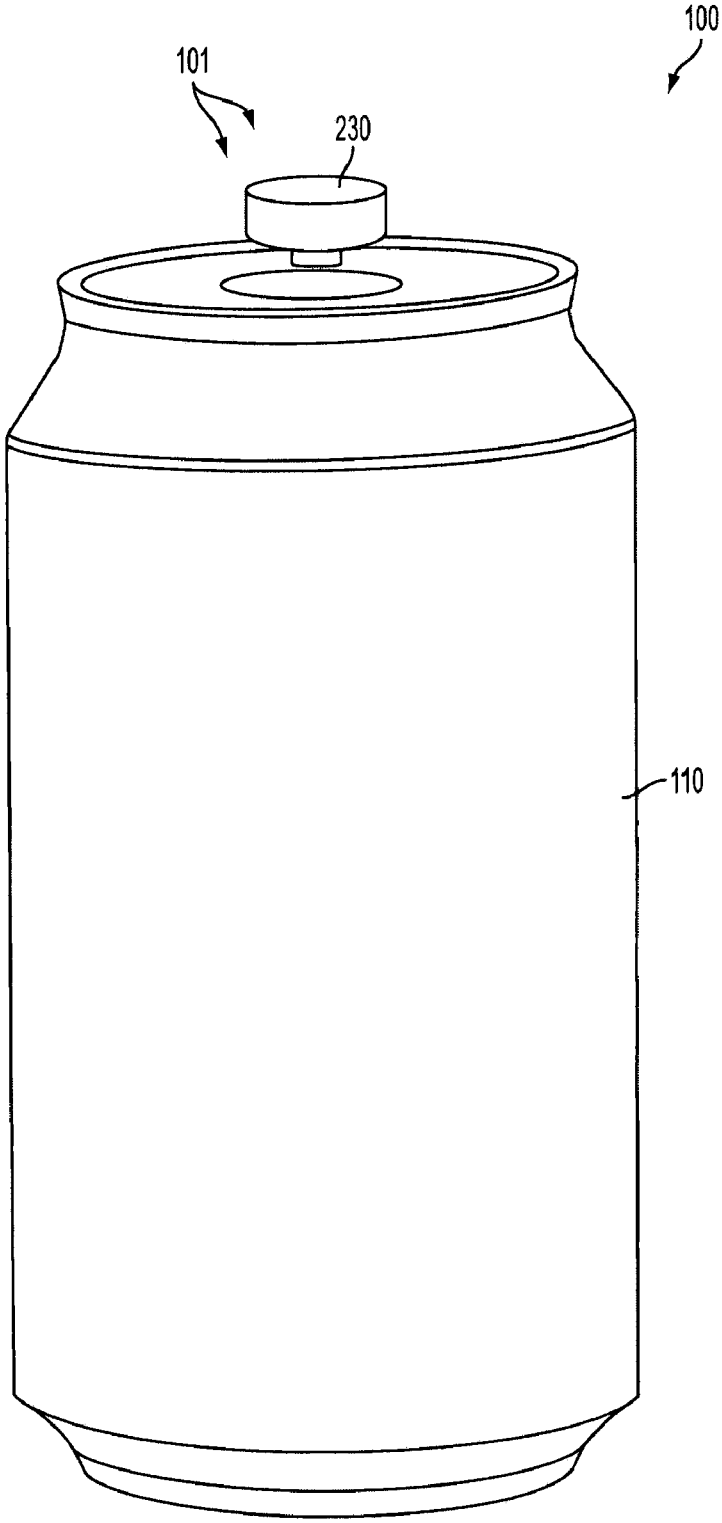
FIG. 1 illustrates a side view of an exemplary embodiment of the embodiment.
Figure 2A:
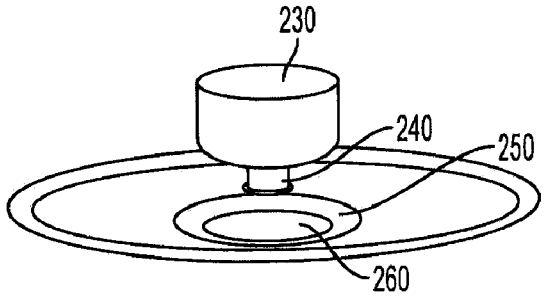
FIG. 2A illustrates another view of the FIG. 1 embodiment described herein.
Figure 2B:
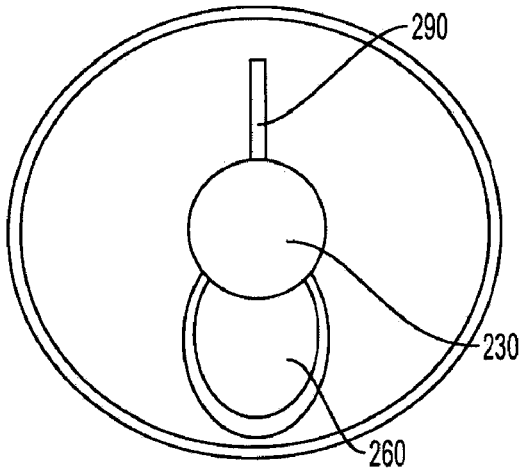
FIG. 2B illustrates another view of the FIG. 1 embodiment described herein.
Figure 2C:
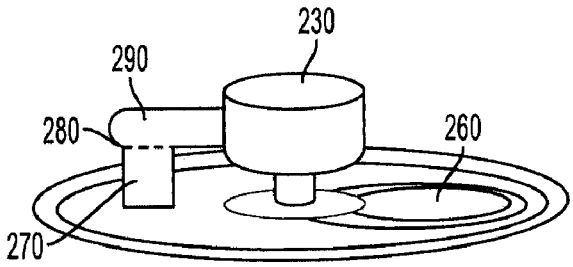
FIG. 2C illustrates another view of the FIG. 1 embodiment described herein.
Figure 3:
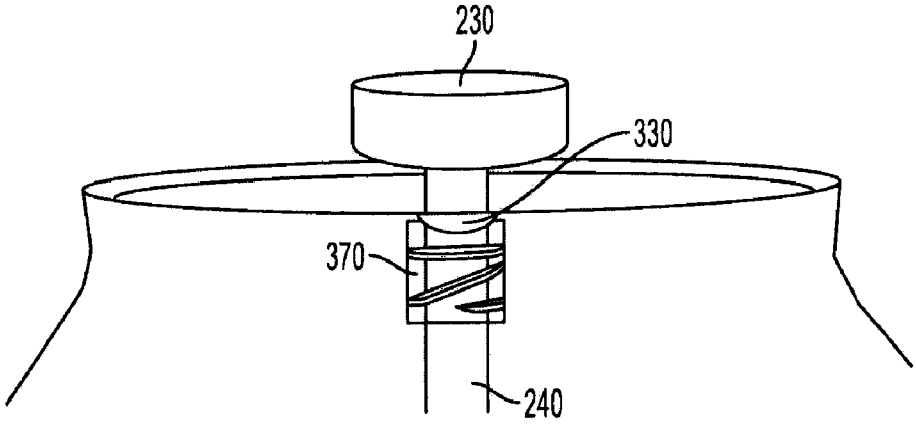
FIG. 3 illustrates another view of the FIG. 1 embodiment described herein.

Embodiments of the present invention relate to a beverage can having a knob device opening assembly that utilizes three components to provide a substantially air-tight, closeable beverage can. The knob device opening assembly allows a user to open and close the can while protecting the integrity of the can. It is known that aluminum cans are advantageous because they allow a beverage to remain cold for a longer period. It is also known that users desire the ability, as in a plastic bottle, to open and close the beverage container at anytime. The beverage can described herein provides the user with both advantages. The embodiments of the beverage can relate to a can that allows a beverage to remain cold for a longer period and has the ability to be opened and closed.

Referring to FIGS. 1-4, the knob device opening assembly 101 comprises three components. The first component is a knob 230 that overlaps, but does not cover, an opening 260 in the can 110 lid. The knob 230 is for the user to control the opening and closing position of the opening assembly 101. The second component comprises a rod 240 and bar extension 470 that is partially enclosed within a box 370 (described in more detail below) for raising and lowering a funnel cap 480. The third component comprises the funnel cap 480 that is located below a funnel 490 that is connected to the opening 260. Funnel 490 is open at the bottom for channeling the liquid in the can 110. The knob 230, rod 240, bar extension 470 and funnel cap 480 are all one continuous piece. It should be appreciated, however, that these elements can also be implemented as separate pieces.

The knob device opening assembly 101 is physically connected through the inside lid of the can 110. That is, the knob 230 extends above the lid of the can while the rod 240, bar extension 470, and funnel cap 480 extend below the lid of the can 110. Box 370 contains threads matching that on the rod 240, allowing rod 240 to lower and raise into the can 110. The box 370 is located under the lid of the can and completely surrounds the rod 240, which connects to the knob 230. It should be appreciated that a piece of thick, but flexible, plastic 330 prevents the leaking of any liquid (e.g., soda) where the rod 240 enters the can. The plastic piece is placed inside the upper portion box 370 around rod 240 at a location where rod 240 enters the interior of the can 110.

In a closed position (FIG. 1), the knob 230, rod 240, bar extension 470 and funnel cap 480 are positioned in a way that seals closed opening 260 in the can. In this position, the knob 230 sits above an indentation 250 partially above opening 260. To sustain the integrity of the seal in its closed position, the funnel 490 has niches 520 on the lower, outer region of the funnel 490 that fit and lock with bumps on the inside of the funnel cap 480.

When opening the can, which is done by rotating the knob 230, the funnel cap 480 is loosened when the knob 230 has been turned approximately 90 degrees. The user will typically hear a pop sound when the seal is broken. When the knob 230 is turned, lever 290 will break from aluminum flap 270 along a perforated edge 280. The aluminum flap 270 will fall back in the direction of the force due to the placement of the perforation and the force applied to turn the knob 230. The lever 290 and aluminum flap 270 serve as identification to the user for determining whether the can 110 has been opened or tampered with. There is a flexible connection between aluminum flap 270 and the lid of the can 110 allowing the aluminum flap 270 to bend at the connection point.

Figure 5:
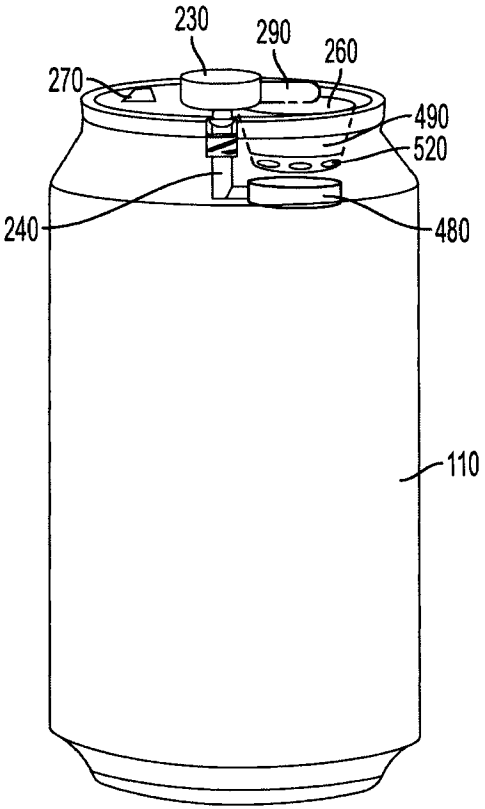
FIG. 5 illustrates the embodiment of FIG. 1 at a stage of use subsequent to that shown in FIG. 4.
Figure 4:
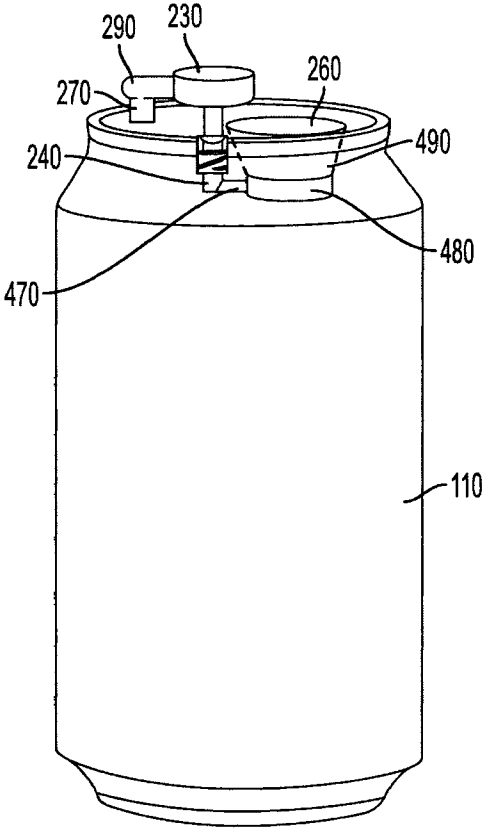
FIG. 4 illustrates a side view of an embodiment of the invention at an initial stage of use from the closed position.
Figure 6:
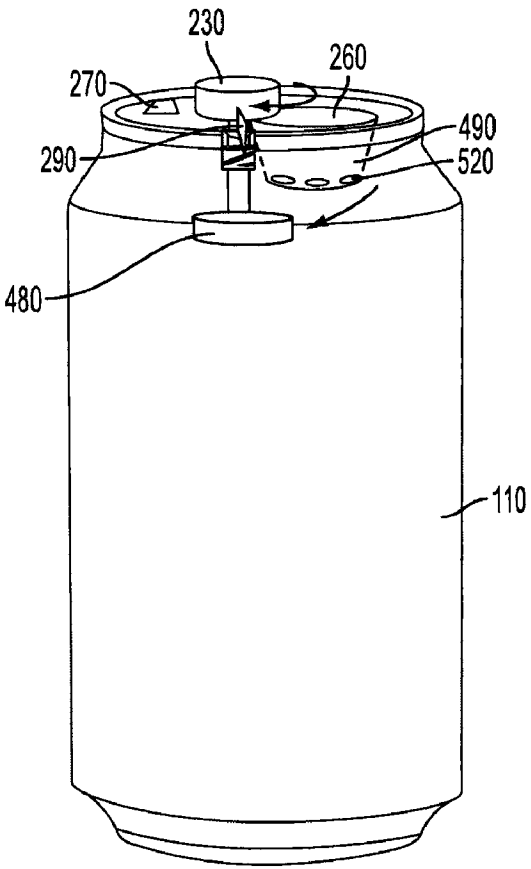
FIG. 6 illustrates the embodiment of FIG. 1 at a stage of use subsequent to that shown in FIG. 4.

Referring to FIGS. 4-6, in the illustrated examples the knob 230 is turned clockwise to loosen the funnel cap 480; the funnel cap 480 begins to lower away from its sealed contact position and from funnel 490. At approximately 180 degrees, as shown in FIG. 5, the continued rotation of knob 230 pushes the rod 240 downward and funnel cap 480 is completely released from the funnel 490. By lowering the position of the funnel cap 480, the open bottom of funnel 490 is exposed to allow liquid to flow out of the can 110. At the completion of approximately 270 degrees of turn (FIG. 6), the funnel cap 480 is moved to the right and away from under the opening 260. The can 110 is now in the open position for drinking, pouring, etc.

Figure 7:
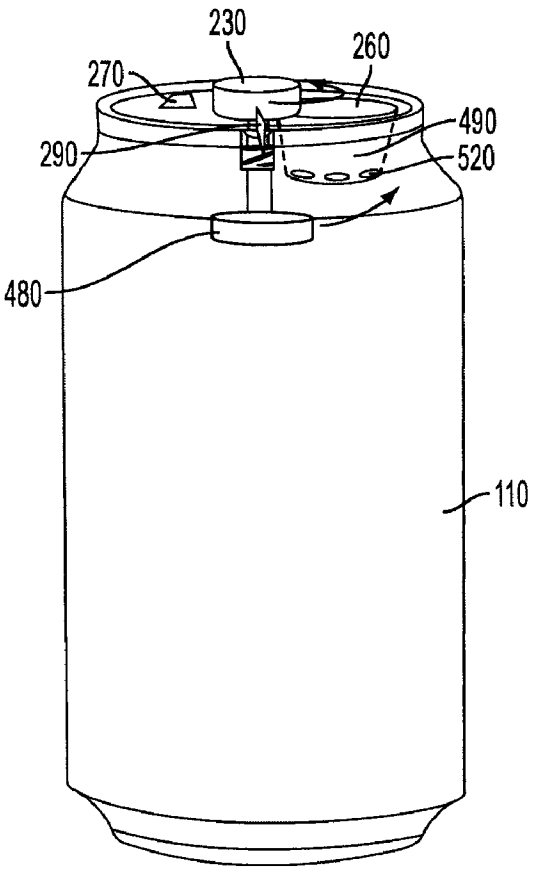
FIG. 7 illustrates an embodiment of the invention at an initial stage of use from the open position.
Figure 9:
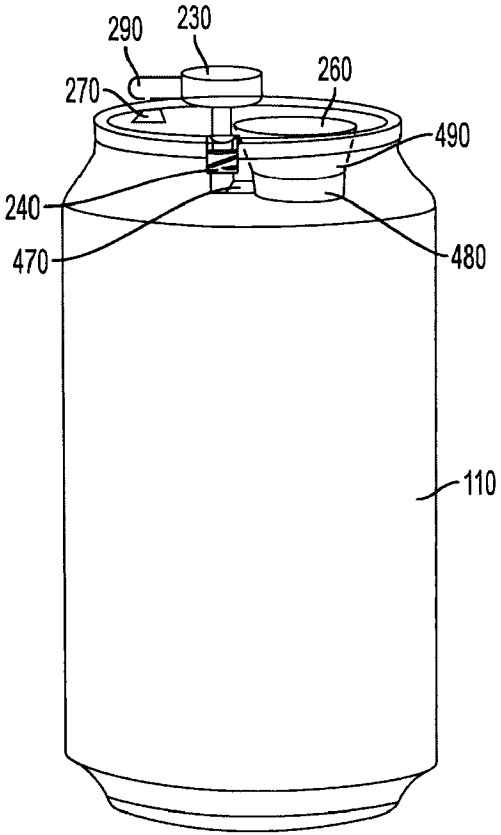
FIG. 9 illustrates the embodiment of FIG. 1 at a stage of use subsequent to that shown in FIG. 8.
Figure 8:
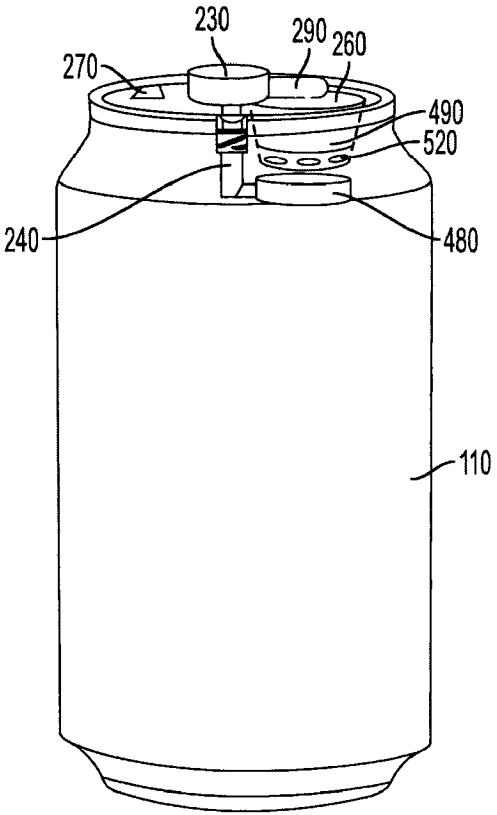
FIG. 8 illustrates the embodiment of FIG. 1 at a stage of use subsequent to that shown in FIG. 7.

To return the can 110 to its closed position, as shown in FIGS. 7-9, a user can turn the knob in the opposite direction, counter-clockwise. It should be appreciated that the invention, although described as opening in a clockwise direction and closing in a counter-clockwise direction, should not be limited to such rotation. The opening assembly can likewise open in a counter-clockwise direction and close in a clockwise direction, if desired. As shown in FIG. 7, at approximately 90 degrees of turn the funnel cap 480 is moved into a position directly under the funnel 490. At approximately 180 degrees of turn, as shown in FIG. 8, the rod 240 and funnel cap 480 are raised upward and the funnel cap 480 is reconnected to funnel 490. At completion of approximately 270 degrees of turn, as shown in FIG. 9, the funnel cap 480 is in contact with funnel 490, and tightened and locked into the closed position. The can 110 is then sealed.

Various modifications may be made without departing from the scope of the invention. For instance, the opening may be any shape, though the oval shape (as illustrated) has been found to be advantageous in that it essentially provides for the automatic correct location of the funnel cap under the opening. The knob and funnel cap may be a different shape or take a different form. The rod may also have a different form. The can may also not include the lever and aluminum flap combination or include a modified version that provides identification to the user whether the can has been opened or tampered with. It should be noted that although the embodiments described above are described in relation to beverage cans, such opening assemblies could be used on a wide range of different containers such as oil containers, cleaning supply containers, detergent containers, ink containers, water containers, etc. It should be additionally appreciated that the degrees of turn described herein are exemplary only and are not limiting.

Having described specific preferred embodiments with reference to the accompanying drawings, it is also to be understood that the invention is not limited to those precise embodiments, and that various changes and modifications may be effected therein by one skilled in the art without departing from the scope or the spirit of the invention as defined in the appended claims.

What is claimed as new and desired to be protected by Letters Patent of the United States is:

1. A beverage can comprising a lid portion having an opening, the beverage can comprising:

an opening assembly comprising:

a knob for opening and closing the opening assembly;

a rod mechanism connected to the knob;

a bar extension connected to the rod mechanism;

a funnel cap connected to the bar extension; and a funnel, which is connected to an inner surface of the lid portion of the beverage can and surrounds the opening, said funnel for channeling liquid out of the beverage can when the opening assembly is in an opened position, wherein rotation of the knob in a first direction causes the rod mechanism to raise the funnel cap into direct contact with the funnel such that the opening is sealed in a closed position, and rotation of the knob in a second direction causes the rod mechanism to lower the funnel cap away from the funnel such that the opening is unsealed and in an opened position.

2. The beverage can of claim 1, wherein the knob, the rod mechanism, the bar extension, and the funnel cap are formed as one continuous piece.

3. The beverage can of claim 1, wherein the rod mechanism raises the funnel cap when the knob is rotated counter-clockwise.

4. The beverage can of claim 1, wherein the rod mechanism lowers the funnel cap when the knob is rotated clockwise.

5. The beverage can of claim 1, wherein the funnel cap comprises bumps and the funnel comprises niches such that when the funnel cap and the funnel are in the closed position, the bumps and niches lock together to seal the opening.

6. The beverage can of claim 1, wherein the rod mechanism, the bar extension, and the funnel cap extend below the lid portion of the beverage can.

7. A re-sealing assembly comprising:

a knob for opening and closing the assembly;

a rod mechanism connected to the knob;

a bar extension connected to the rod mechanism;

a funnel cap connected to the bar extension; and a funnel adapted to be connected to an inner surface of a container and surrounding an opening in the container, wherein rotation of the knob causes the rod mechanism to raise the funnel cap and seal the opening in a closed position by positioning the funnel cap in direct contact with the funnel, or causes the rod mechanism to lower the funnel cap to unseal the opening in an open position by positioning the funnel cap at a distance from the funnel.

8. The re-sealing assembly of claim 7, wherein the rod mechanism raises the funnel cap when the knob is rotated counter-clockwise.

9. The re-sealing assembly of claim 7, wherein the rod mechanism lowers the funnel cap when the knob is rotated clockwise.

10. The re-sealing assembly of claim 7, wherein the funnel cap comprises bumps and the funnel comprises niches such that when the funnel cap and the funnel are tightened and locked, the opening assembly is in a sealed position.

11. The beverage can of claim 1, further comprising an identification mechanism for determining whether the beverage can has been opened or tampered with.

12. The beverage can of claim 11, wherein the identification mechanism comprises a lever and an aluminum flap.

* * * * *